US005779556A

United States Patent [19]

Cervantes et al.

[11] Patent Number: 5,779,556

[45] Date of Patent: Jul. 14, 1998

[54] GOLF CLUB POINT OF IMPACT AND RELATIVE CLUB VELOCITY INDICATOR

[76] Inventors: Eduardo Cervantes, 64 Winding Run Ln., Streamwood, Ill. 60107; Steven R. Puschmann, 2171 W. Sunnyside, Chicago, Ill. 60625

[21] Appl. No.: 680,991

[22] Filed: Jul. 16, 1996

[51] Int. Cl.[6] ..... A63B 69/36

[52] U.S. Cl. ..... 473/237

[58] Field of Search ..... 473/237, 219

[56] References Cited

U.S. PATENT DOCUMENTS 2,660,436 11/1953 Grossman .
3,754,764 8/1973 Manheck .
5,033,746 7/1991 Jones .
5,142,309 8/1992 Lee .
5,597,361 1/1997 Hope ..... 473/237

*Primary Examiner*—George J. Marlo
*Attorney, Agent, or Firm*—Meroni & Meroni

[57] ABSTRACT

A golf club point of impact and relative club velocity indicator for recording the relative velocity and location at which the head of a golf club impacts a golf ball includes:

a. a heat sensitive chemical top coating for providing a permanent black image if heat is applied thereto, said coating including a layer of direct thermal face stock, b. a fibrous paper having first and second sides, the first side being secured with the layer of direct thermal face stock, and c. an adhesive backing secured to the second side of the fibrous paper, the adhesive backing being adapted for removable attachment to the striking face of a golf club.

1 Claim, 1 Drawing Sheet

GOLF CLUB POINT OF IMPACT AND RELATIVE CLUB VELOCITY INDICATOR

BACKGROUND

1. Field of Invention

The invention relates to a training aid used to record the point of impact and relative club velocity between a golf club and golf ball.

2. Description of Prior Art

The game of golf requires a swing that maximizes control over the direction and distance a golf ball travels upon impact. There are several factors that affect a golfer's control over a golf ball: stance, grip, back swing, down swing, pivoting of body, shifting of body weight, club velocity, and the point of impact of the golf ball on the club face. The point of impact between the golf ball and the club face is extremely important because the shape, weight, and balance of the head of the golf club is not uniform throughout the face of the club. A swing that results with an impact on the center of the club face, also known as the "sweet spot", will afford a golfer better control of the direction of the golf ball. The further away the impact is from the sweet spot, the less control the golfer will have. The velocity of the club swing at impact is a very important factor in determining how far a golf ball will travel after impact.

In order to determine the location of the impact of a golf club against a golf ball, golfers have relied upon observing the flight of the golf ball after impact and upon the tactile sensation felt in the golfer's hand and forearms to generate a subjective impression. This method of evaluation is very inaccurate and does not provide golfers with sufficient information concerning the location of impact to allow the golfers to adjust their swings to correct the flaw.

Golfers have also examined the faces of their clubs after a swing for some indication of the location of impact, such as dirt particles or grass stains which may have been transferred from the golf ball to the club face upon impact. This method is very unreliable.

Golf club point of impact indicators are known in the prior art as evidenced by U.S. Pat. No. 3,754,764 issued to Manheck on Aug. 28, 1973; U.S. Pat. No. 2,660,436 issued to Grossman on Nov. 24, 1953; and U.S. Pat. No. 5,142,309 issued to Lee on Aug. 25, 1992. These prior art constructions do not give any indication of relative club velocity when the club face strikes a golf ball. U.S. Pat. No. 3,754,764 issued to Manheck on Aug. 28, 1973 uses carbonless papers which do not produce a clear, distinct, crisp image and are relatively complex and expensive constructions composed of rupturing capsules. U.S. Pat. No. 2,660,436 issued to Grossman on Nov. 24, 1953 is also a complex and expensive construction consisting of a top layer of wax that is removed when a golf ball strikes the surface of the indicating disk. This construction also leaves a residue on the golf ball which is objectionable to golfers. U.S. Pat. No. 5,142,309 issued to Lee on Aug. 25, 1992, is also a complex and expensive construction. In operation, an impact causes dye capsules to be ruptured, further causing dye contained in other capsules to come into contact with dye co-reactants. A chemical reaction results causing the dye to change color at the point of impact. The mark of this construction is not instantaneous because time is needed for the chemical reaction to be completed. The prior art has a layer of protective film that prevents the underlying layer of paper from being destroyed due to moisture. In summary, these complex constructions have made these prior art systems very expensive. The subject invention overcomes the problems of the prior art in a lightweight, inexpensive, yet, very effective point of impact and relative club velocity indicator.

SUMMARY OF INVENTION AND ADVANTAGE

The present invention is a system for recording the point of impact of a golf ball on the face of a golf club and to determine the relative club velocity at impact. The system comprises a recording medium which is attachable to the head of a golf club and is removable from the club after the ball impacts the club. When the golf club bearing the point of impact and relative club velocity indicator strikes the golf ball, a mark is made on the point of impact and relative club velocity indicator which records the point of impact. This mark provides the golfer with information to adjust his swing or stance if necessary in order to properly hit the golf ball on his next swing. After multiple impacts, relative club velocity at impact can be assessed by examining the marks left on the point of impact and relative club velocity indicator. Darker and bigger diameter impact marks will indicate a greater club velocity at impact than lighter, smaller diameter marks.

The point of impact and relative club velocity indicator is attached to the face of the golf club with a removable adhesive to facilitate the removal of the point of impact and relative club velocity indicator after one or more impacts. Prior to attaching the point of impact and relative club velocity indicator to the club face, the point of impact and relative club velocity indicator is attached to a backing material to prevent the point of impact and relative club velocity indicator from adhering to unintended objects.

More specifically, the subject invention is directed toward a golf club point of impact and relative club velocity indicator for indicating the location at which the head of a golf club impacts a golf ball including a sheet of heat sensitive recording medium having first and second sides and including means for indicating the point of impact on the medium. The point of impact and relative club velocity indicator is a very simple construction, extremely economical, produces an image that is sharper than prior art, has the ability to have a white background or any other suitable background color to contrast the black image left after impact. The prior art is limited to one background color that approximates the color of the mark left. This limits the contrast. The subject invention also has the ability to record relative club velocity which is not present in prior art.

BRIEF DESCRIPTION OF THE DRAWINGS

The drawings, which constitute a part of the specification, are as follows.

REFERENCE NUMERALS IN DRAWINGS

Figure 1:
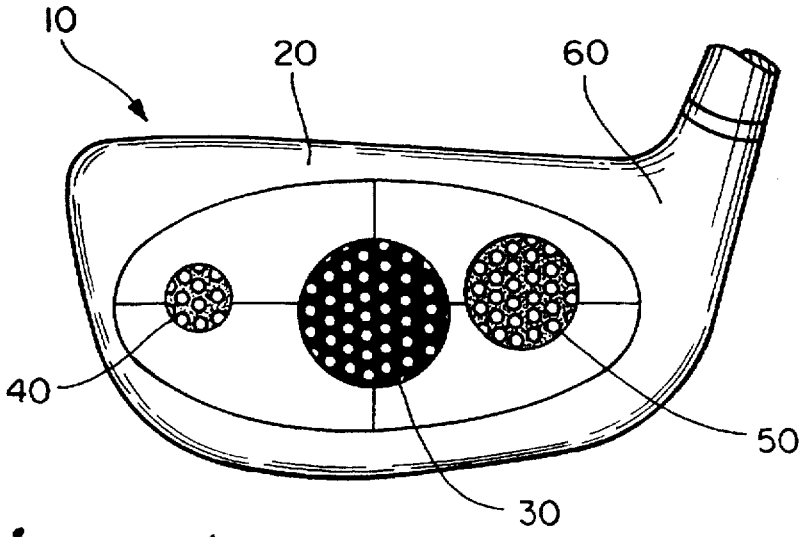
FIG. 1 is a front elevational view of a point of impact and relative club velocity indicator constructed according to a preferred embodiment of the present invention, as attached to the head of a golf club and bearing recordings of impacts of the club head against one or more golf balls.

10 point of impact and relative club velocity indicator

20 club head

30 mark

40 mark

50 mark

60 golf club

70 backing material (liner)

80 heat sensitive chemical-top coat

90 face stock

100 removable adhesive

110 silicone

120 fibrous paper

DETAILED DESCRIPTION OF THE PREFERRED EMBODIMENT

Referring initially to FIG. 1, the point of impact and relative club velocity indicator (10) of the preferred embodiment of the present invention is shown as attached to, and used on, the club head (20) of a golf club (60). For purposes of illustration, the type of club known as a "wood" is depicted. However, it is to be understood that the point of impact and relative club velocity indicator (10) of the present invention may be applied to, and used on, both "irons" and "woods" of all shapes and sizes. It is also to be understood that the point of impact and relative club velocity indicator can be any size, shape, or color.

The point of impact and relative club velocity indicator (10) is attached to the face the club head (20) and records the location on the club head (20) where the golf club (60) impacts a golf ball (not shown). A mark (30) appears on the point of impact and relative club velocity indicator (10) when the club head (20) impacts a golf ball and further marks (40) and (50) appear on the point of impact and relative club velocity indicator (10) upon subsequent impacts.

The center mark (30) shown in FIG. 1 indicates that the golfer swinging the golf club (60) hit the ball at the approximate, optimum location of the club head (20), also known as the "sweet spot", for maximum distance and control, as determined by weight, balance and overall construction and design of the golf club (60). The center mark (30) provides the golfer with information indicating that one major element of his golf club swinging technique, that of hitting the golf ball at the sweet spot of the club head (20), was properly executed.

The marks (40) and (50) provide the golfer with information indicating that his golf swinging technique was not properly executed when the marks were made on the point of impact and relative club velocity indicator (10). The golfer can use this information to adjust his technique in order to achieve proper execution. For example, after observing that the golfer has hit the golf ball improperly, the golfer looks at the point of impact and relative club velocity indicator (10) to determine the location on the club head (20) where the golf club (60) impacted the ball. Upon inspecting the mark (40) on the point of impact and relative club velocity indicator (10), the golfer realizes that he hit the ball with the outer edge of the club head (20) and can adjust his next stance or stroke to compensate for the mis-hit. The mark (40) shows the golfer not only that he hit the ball improperly with his last stroke, but also the location and distance from the sweet spot. After multiple impacts, relative club velocity at impact can be measured. By comparing the marks (30), (40), and (50), the golfer can determine that the swing that made mark (30) had a greater club velocity at impact than the swings that made marks (40) and (50). This is apparent because mark (30) has a darker image and has a greater diameter than marks (40) and (50). Studies have shown that the impact of a club head on a golf ball can generate a peak load of over five thousand pounds of force. This force causes the golf ball to partially flatten out upon impact. The greater the club velocity at impact, the greater the force. This greater force will cause a golf ball to flatten out more than a swing with a lessor force. The more the golf ball flattens out, the more it will come into contact with the point of impact and relative club velocity indicator (10). Therefore leaving a bigger diameter mark (30). A greater force will also generate greater friction, and therefore more heat. This greater heat will leave a darker image (30) than that of (40) and (50), which were made by swings with less velocity.

The point of impact and relative club velocity indicator (10) is attached to the club head (20) with a releasable adhesive substance (not shown) of the type known to be used with removable labels. After one or more impacts of the golf club against the golf ball have been recorded on the point of impact and relative club velocity indicator (10), the golfer may remove the point of impact and relative club velocity indicator (10) from the club head (20) in order to replace the used point of impact and relative club velocity indicator (10) with a new point of impact and relative club velocity indicator (10) or to use or store the golf club without a point of impact and relative club velocity indicator (10).

Figure 2:
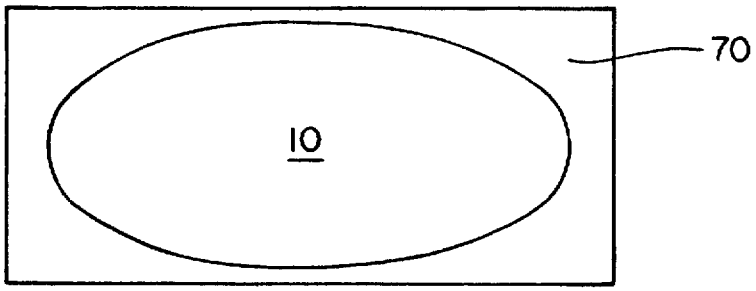
FIG. 2 is a front elevational view of the point of impact and relative club velocity indicator of FIG. 1 as attached to a sheet of backing material.

Referring now to FIG. 2, a point of impact and relative club velocity indicator (10) is shown attached to a piece of backing material (70), also known as a liner in the pressure sensitive face stock industry. This backing material (70) acts a temporary backing prior to use of the point of impact and relative club velocity indicator (10). The backing material (70) prevents the point of impact and relative club velocity indicator (10) from adhering to unintended objects and permits it to be removed easily from the backing material (70) when use is desired.

Figure 3:
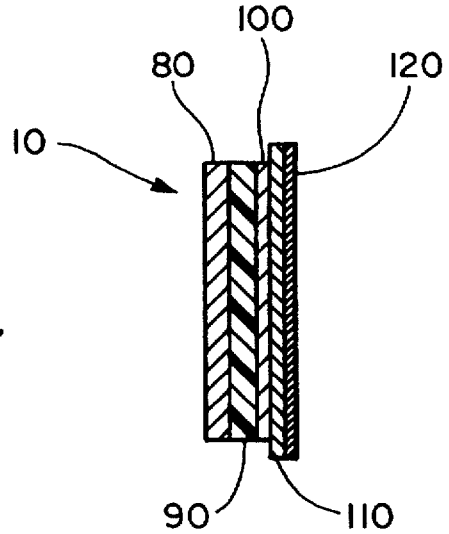
FIG. 3 is a representational cross-sectional side view of the point of impact and relative club velocity indicator and backing material of FIG. 2.

FIG. 3, is a representational cross-sectional view of one embodiment of the point of impact and relative club velocity indicator (10) attached to the backing material (70). The dimensions of FIG. 3, are illustrative only and do not represent accurate proportional measurements. The point of impact and relative club velocity indicator (10) is shown as a composite of three layers comprising a heat sensitive chemical top-coating (80), known AS direct thermal face stocks; a face stock (90) such as paper or film of the type used in pressure sensitive labels; a removable adhesive (100), of the type known to be used in removable labels. The combination of inexpensive materials, such as paper, provides a significant economic advantage over the recording mediums that have expensive laminates on the face of the prior art.

A layer of removable adhesive (100), such as the type used on known removable labels, is applied to the surface of the face stock (90), opposite the chemical top coating (80). The adhesive (100) is permanently bonded to the face stock (90) so that it remains bonded to the face stock (90) upon removal of the point of impact and relative club velocity indicator (10) from the backing material (70), and upon subsequent removal of the point of impact and relative club velocity indicator (10) from the club head (20). The adhesive (100) does not become permanently bonded to either the backing material (70) or the club head (20) when the point of impact and relative club velocity indicator (10) is attached to these articles. This allows easy removal of the point of impact and relative club velocity indicator (10) from the backing material (70) and club head (20).

The backing material (70) is shown as a composite of two layers comprising a layer of silicone (110) and a layer of fibrous paper (120). The layer of silicone (110) provides a relatively smooth and non-porous surface upon which to attach the point of impact and relative club velocity indicator (10) without creating a permanent bond between the point of impact and relative club velocity indicator (10) and the backing material (70). That is, the silicone layer (110) prevents the adhesive layer (100) from adhering to the layer of fibrous paper (120) of the backing material (70). In operation, the point of impact and relative club velocity indicator (10) is attached to the backing material (70) by adhering the adhesive layer (100) of the point of impact and relative club velocity indicator (10) to the silicone layer (110) of the backing material (70) for temporary protection of the adhesive layer (100). When the use of the point of impact and relative club velocity indicator (10) on the club head (20) is desired, the point of impact and relative club velocity indicator (10) is removed from the backing material (70) and attached to the club head (20), as shown in FIG. 1. The backing material (70) may then be discarded. It is to be understood that other embodiments of backing material, including but not limited to silicone paper, are possible without departing from the scope of the present invention.

The components of the point of impact and relative club velocity indicator are readily available from pressure sensitive face stock dealers, such as Fasson, 7670 Auburn Rd., Painesville Ohio, 44077; Ricoh, 2320 Redhill Ave., Santa Ana, Calif. 92705; Greenbay Packaging, 3250 S. Ridge Rd., Greenbay, Wis., 54307; Mactac, 4560 Darrow Rd., Stow, Ohio 44224; Kanzaki, 171 Dwight Rd, Ste. 305, Longmeadow, Mass. 01106.

The foregoing description of the preferred embodiment is illustrative of the best mode presently contemplated by the inventors for embodying the present invention. It is to be understood, however, that other embodiments are possible without departing from the scope and spirit of the present invention.

What we claim is:

1. A golf club point of impact and relative club velocity indicator for recording the relative velocity and the location at which the head of a golf club impacts a golf ball, said apparatus comprising:

a. a heat sensitive chemical top coating means for providing a permanent black image if heat is applied thereto, said means including a layer of direct thermal face stock, b. a fibrous paper having first and second sides, the first side being secured with said layer of direct thermal face stock, and c. an adhesive backing secured to the second side of said fibrous paper, the adhesive backing being adapted for removable attachment to a golf club.

* * * * *